US005488452A

United States Patent [19]

Iwama

[11] Patent Number: 5,488,452

[45] Date of Patent: Jan. 30, 1996

[54] SERIAL TYPE ELECTROPHOTOGRAPHY PRINTER FOR FORMING A LATENT IMAGE AND DEVELOPING AND PRINTING THE DEVELOPED IMAGE

[75] Inventor: Ryoichi Iwama, Kawasaki, Japan

[73] Assignee: Fujitsu Limited, Kawasaki, Japan

[21] Appl. No.: 278,324

[22] Filed: Jul. 21, 1994

[30] Foreign Application Priority Data

Sep. 16, 1993 [JP] Japan ..... 5-230444

[51] Int. Cl.[6] ..... G03G 21/00

[52] U.S. Cl. ..... 355/202; 347/112; 347/156; 355/282

[58] Field of Search ..... 355/200, 202, 355/210–212, 235, 282, 285; 347/3, 102, 112, 156

[56] References Cited

U.S. PATENT DOCUMENTS 4,403,849 9/1983 Burger et al. ..... 355/235 X
4,845,519 7/1989 Fuse ..... 355/212 X

*Primary Examiner*—William J. Royer
*Attorney, Agent, or Firm*—Armstrong, Westerman, Hattori, McLeland & Naughton

[57] ABSTRACT

A serial type electrophotography printer includes a transport mechanism for transporting a recording sheet in a transport direction, a carriage including a process part and a fixing unit, where the process part includes an image bearing member rotatable about a rotary axis parallel to the transport direction of the recording sheet and a toner developing a latent image formed by charging the image bearing member, the fixing unit includes a rotatable fixing member and a heater for heating the fixing member, and the fixing member fixes a developed image which is transferred onto the recording sheet from the image bearing member, a driving mechanism for rotating the image bearing member and the fixing member when the carriage is moved to carry out developing, transfer and fixing processes with respect to the recording sheet, and for rotating at least one of the image bearing member and the fixing member during a predetermined time other than the time when the carriage is moved to carry out the developing, transfer and fixing processes, a transfer unit confronting the carriage via the recording sheet in a main scan direction of the carriage for transferring the developed image on the image bearing member onto the recording sheet, and a moving mechanism for moving the carriage in the main scan direction which is perpendicular to the transport direction of the recording sheet.

10 Claims, 8 Drawing Sheets

SERIAL TYPE ELECTROPHOTOGRAPHY PRINTER FOR FORMING A LATENT IMAGE AND DEVELOPING AND PRINTING THE DEVELOPED IMAGE

BACKGROUND OF THE INVENTION

The present invention generally relates to printers, and more particularly to a serial type electrophotography printer provided with a fixing unit within a carriage which carries out the printing.

Recently, a serial type electrophotography printer has been developed to satisfy the demands to reduce both the cost and size of electrophotography type recording apparatuses. The serial type electrophotography printer is provided with an electrophotography process means on a carriage which carries out the printing. According to such a serial type electrophotography printer in general, a transfer unit transfers an image on a recording sheet which is transported, by moving the carriage in a direction perpendicular to a transport direction of the recording sheet, and the image is fixed by a fixing unit which has the form of a roller and is arranged on the downstream side of the transfer unit along the transport direction. In order to further reduce the size of the printer, a printer provided with the fixing unit within the carriage has also been developed. In such a printer, there are demands to print an image having a high quality and to guarantee safety.

FIGS. 1A through 1C are diagrams showing important parts of a conceivable serial type electrophotography printer. FIG. 1A shows a plan view of a carriage part, FIG. 1B shows a cross section taken along a line A—A in FIG. 1A, and FIG. 1C shows a cross section taken along a line B—B in FIG. 1A.

In FIGS. 1A through 1C, a carriage 11 is made up of a process part 12 and a fixing unit 13. The carriage 11 is guided by shafts 14*a* and 14*b*, and is moved in a main scan direction by a driving motor (not shown) above a transfer unit (printing platen) 15. This main scan direction is perpendicular to a transport direction of a recording sheet 17. Transport rollers 16*a* and 16*b* are arranged on both sides of the carriage 11 along the transport direction. The recording sheet 17 is transported by the transport rollers 16*a* and 16*b* between the transfer unit 15 and the carriage 11.

An image bearing member 21 is provided on the process part 12 of the carriage 11, and this image bearing member 21 rotates at a peripheral speed synchronized to the movement of the carriage 11. The surface of the image bearing member 21 is uniformly charged by a charger 22, and an electrostatic latent image is formed on the surface of the image bearing member 21 by an exposure unit 23. The electrostatic latent image is visualized into a toner image by a developing roller 24. The toner image formed on the image bearing member 21 is transferred onto the recording sheet 17 by the transfer unit 15 which confronts the image bearing member 21 with the recording sheet 17 interposed therebetween. The residual toner on the image bearing member 21 is removed by a cleaner 25.

The surface of the cleaned image bearing member 21 is charged again by the charger 22, and a printing process is repeated similarly as described above. When the printing amounting to a predetermined width ends, the recording sheet 17 is transported a predetermined amount by the transport rollers 16*a* and 16*b*, and the carriage 11 is returned to a predetermined position (home position) so as to carry out a printing operation again.

The transfer of the toner image by the transfer unit 15 is made by applying a predetermined voltage across the transfer unit and the image bearing member 21. Hence, the transfer unit includes a heat resistant conductor portion 15*b* which is made of a conductive rubber or the like and is formed on a substrate 15*a*.

On the other hand, the fixing unit 13 is provided with a fixing roller 26 and a heater part 27 arranged in a vicinity of the fixing roller 26. The heater part 27 preheats the fixing roller 26 to a predetermined temperature before the printing operation of the process part 12 starts. The temperature of the fixing roller 26 during the printing is controlled by detecting the temperature by a temperature detector (not shown) such as a thermistor. The fixing unit 13 moves together with the process part 12 and carries out the fixing process immediately after the transfer process of the process part 12.

FIG. 2 shows a cross section of another conceivable carriage. In FIG. 2, those parts which are the same as those corresponding parts in FIGS. 1A through 1C are designated by the same reference numerals, and a description thereof will be omitted.

In the carriage 11 shown in FIG. 2, a halogen lamp (infrared ray lamp) 28 is provided in the fixing unit 13 as a heater means, and in addition, a reflecting mirror 29 is arranged around the periphery of this halogen lamp 28. Hence, this fixing unit 13 uses direct irradiation of the halogen lamp 28 when fixing the toner image that is transferred onto the recording sheet 17.

However, when the carriage 11 returns to the home position or is in a standby state, the developing roller 24, the cleaner 25 and the charger 22 are pushed against the image bearing member 21 for a long time. As a result, there are problems in that the material components of the developing roller 24 and the like adhere on the image bearing member 21, and unwanted toner adheres on the image bearing member 21 to cause undesirable effects at the time of the printing such as developing a residual image. In addition, there is a problem in that it is difficult to carry out a charging operation to restore the potential of the image bearing member 21.

On the other hand, in the case of the so-called cleanerless process which eliminates the cleaner part so as to reduce the size of the cartridge and to improve the handling by the user, it is necessary to recover the residual toner on the image bearing member 21 by the developing roller 24 after the transfer process. In other words, unless the surface of the image bearing member 21 is completely cleaned by this recovery operation (developing operation) of the developing roller 24 before starting the printing from the home position, there is a problem in that the residual toner on the surface of the image bearing member 21 will be transferred onto the recording sheet 17 during a next printing operation, thereby deteriorating the quality of the printed image.

Moreover, when the fixing roller 26 is heated by the heater part 27 in a vicinity thereof in the fixing unit 13, the temperature difference on the surface of the fixing roller 26 becomes large when the fixing roller 26 is stationary. In this case, it is difficult to quickly start the printing operation because of the large temperature difference. Further, in order to heat a low temperature part of the fixing roller 26 to a predetermined temperature, it is necessary to set the heating temperature greater than a rated value. But in this case, there are problems in that a short-circuit may occur due to the melting of the heated part, and a member such as a flange which is arranged in a vicinity of the fixing roller 26 and holds the fixing roller 26 may also melt.

Moreover, when the fixing roller 26 remains in the stationary state for a long time, it becomes necessary to provide a means for dispersing the toner with respect to the fixing roller 26. Consequently, there is a problem in that it is difficult to reduce the size of the printer while enabling easy maintenance.

In addition, there is also a problem in that the toner which is not fixed may adhere on the fixing roller 26 during the printing operation, and this toner may be transferred to the recording sheet 17 during the next printing operation to thereby deteriorate the quality of the printed image.

SUMMARY OF THE INVENTION

Accordingly, it is a general object of the present invention to provide a novel and useful printer in which the problems described above are eliminated.

Another and more specific object of the present invention is to provide a serial type electrophotography printer comprising transport means for transporting a recording sheet in a transport direction, a carriage including process means and fixing means, where the process means includes an image bearing member rotatable about a rotary axis parallel to the transport direction of the recording sheet and a toner developing a latent image formed by charging the image bearing member, the fixing means includes a rotatable fixing member and heating means for heating the fixing member, and the fixing member fixes a developed image which is transferred onto the recording sheet from the image bearing member, driving means for rotating the image bearing member and the fixing member when the carriage is moved to carry out developing, transfer and fixing processes with respect to the recording sheet, and for rotating at least one of the image bearing member and the fixing member during a predetermined time other than the time when the carriage is moved to carry out the developing, transfer and fixing processes, transfer means, confronting the carriage via the recording sheet in a main scan direction of the carriage, for transferring the developed image on the image bearing member onto the recording sheet, and moving means for moving the carriage in the main scan direction which is perpendicular to the transport direction of the recording sheet. According to the serial type electrophotography printer of the present invention, it is possible to obtain a printed image having a high quality by appropriately rotating at least one of the image bearing member and the fixing member during the predetermined time other than the time when the developing, transfer and fixing processes are carried out. In addition, it is possible to improve the safety because the fixing member will not be raised to an extremely high temperature, and it is unnecessary to heat the fixing member to a temperature above the rated value because the temperature distribution on the surface of the fixing member will becomes approximately uniform by rotating the fixing member. Furthermore, it is possible to prevent substances from adhering on the surface of the image bearing member by rotating and charging the image bearing member in a standby state where the carriage is located at a receded position, and in this case, it is possible to prevent the image quality from deteriorating even in the case of a cleanerless process.

Other objects and further features of the present invention will be apparent from the following detailed description when read in conjunction with the accompanying drawings.

DESCRIPTION OF THE PREFERRED EMBODIMENTS

Figure 1A:
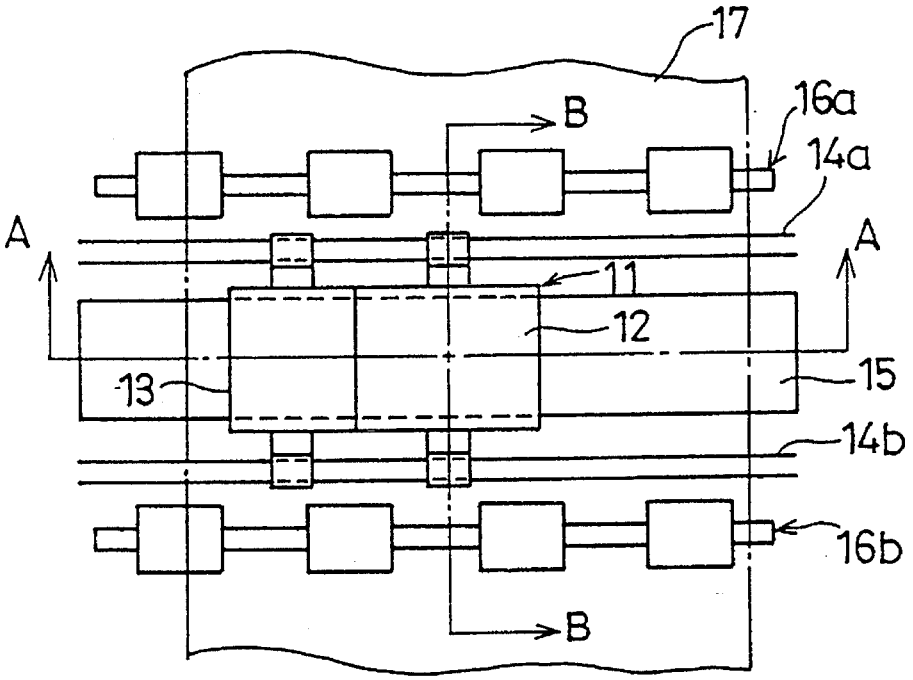
FIG. 1A PRIOR ART
FIGS. 1A, 1B and 1C respectively are a plan view, a cross sectional view and a cross sectional view showing an important part of a conceivable serial type electrophotography printer.
Figure 1B:
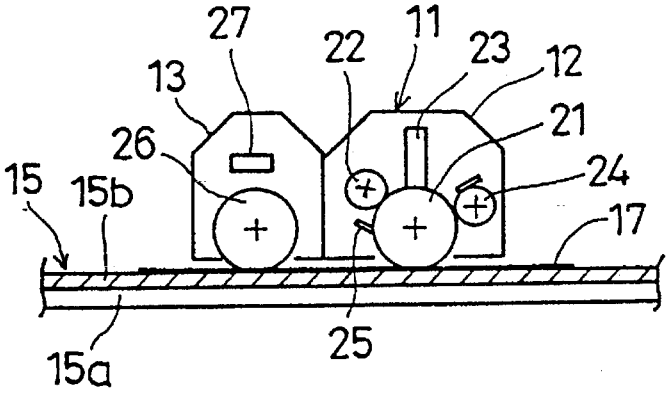
FIG. 1B PRIOR ART
Figure 1C:
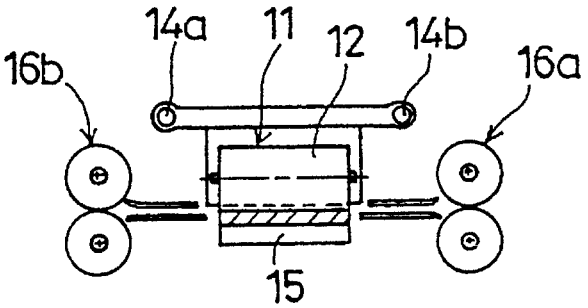
FIG. 1C PRIOR ART
Figure 2:
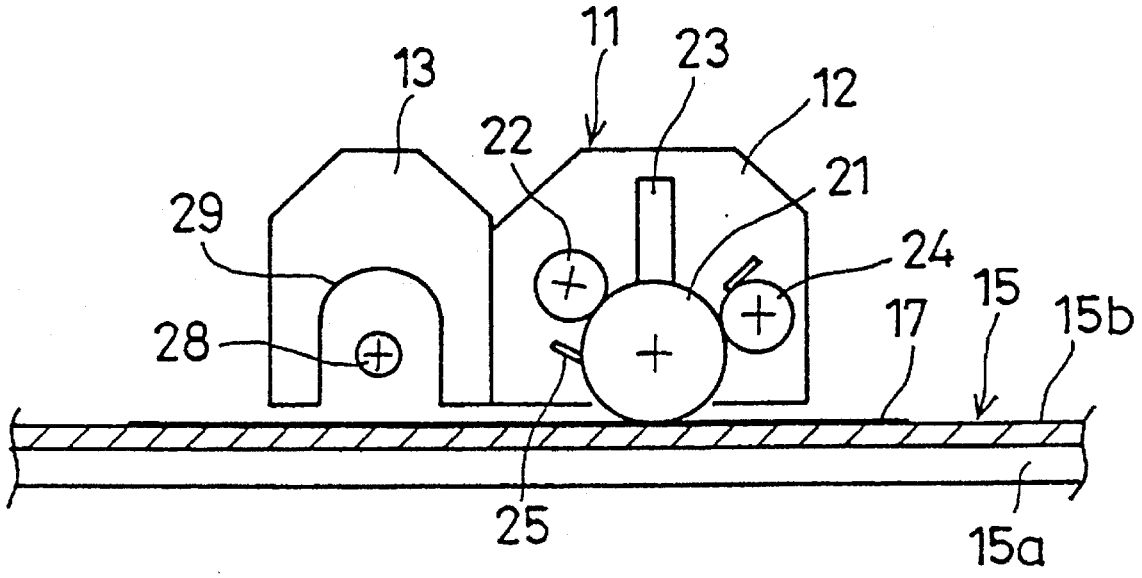
FIG. 2 PRIOR ART
FIG. 2 is a cross sectional view showing another conceivable carriage.
Figure 3:
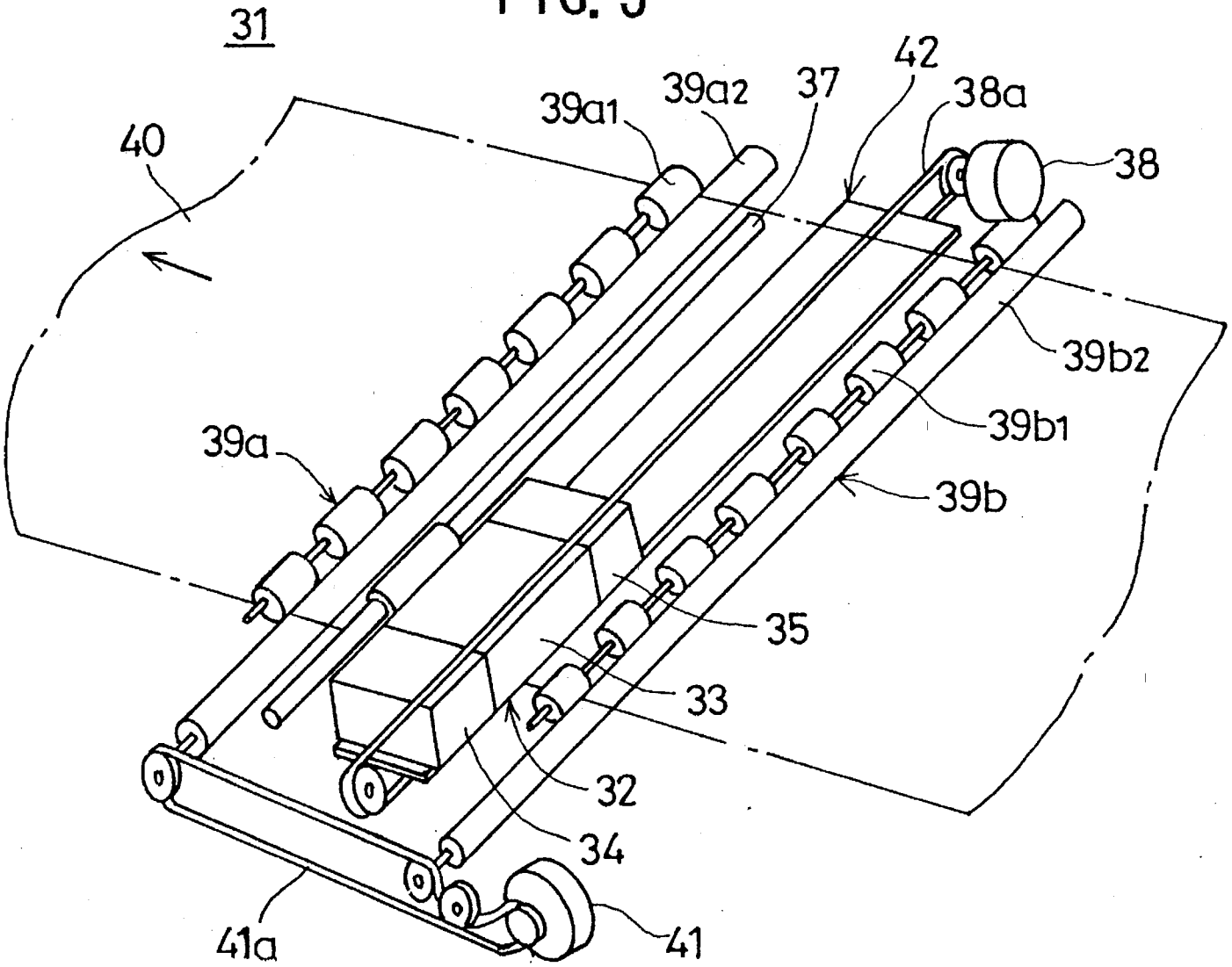
FIG. 3 is a perspective view generally showing a first embodiment of a printer according to the present invention.

FIG. 3 generally shows a first embodiment of a printer according to the present invention.

A serial type electrophotography printer 31 shown in FIG. 3 includes a carriage 32 which is made up of a process part 33, a fixing part 34 and a process motor 35 which forms a driving means. The carriage 32 is mounted on a holder 36 which is not shown in FIG. 3 but shown in FIGS. 5A and 5B which will be described later. The holder 36 is guided by a shaft 37, and is moved in a main scan direction by a carriage motor 38 which forms a driving means via a belt 38*a*. The main scan direction is perpendicular to a transport direction of a recording sheet 40.

Transport rollers 39*a* and 39*b* are provided on a main body (or the chassis) of the printer 31 as a means for transporting the recording sheet 40 on both sides of the carriage 32. Axes of the transport rollers 39*a* and 39*b* extend in the same direction as an axis of the carriage 32. The transport rollers 39*a* and 39*b* respectively pinch and transport the recording sheet 40 by two rollers, namely, the rollers 39*a*1 and 39*a*2, and the rollers 39*b*l and 39*b*2. These transport rollers 39*a* and 39*b* are driven by a transport motor 41 via a belt 41*a*.

On the other hand, a transfer unit 42 is provided on the main body (or the chassis) of the printer 31 as a transfer means, under the carriage 32. This transfer unit 42 includes a substrate made of aluminum or the like, and a heat resistant conductive member formed on the substrate. For example, the heat resistant conductive member is made of silicon rubber mixed with a conductive material. In other words, the transported recording sheet 40 is positioned between the transfer unit 42 and the carriage 32.

Although not shown in FIG. 3, a carriage receding mechanism is provided as will be described later in conjunction with FIGS. 5A and 5B. This carriage receding mechanism engages the carriage 32 and raises the carriage 32 so as to separate it from the transfer unit 42.

Figure 4:
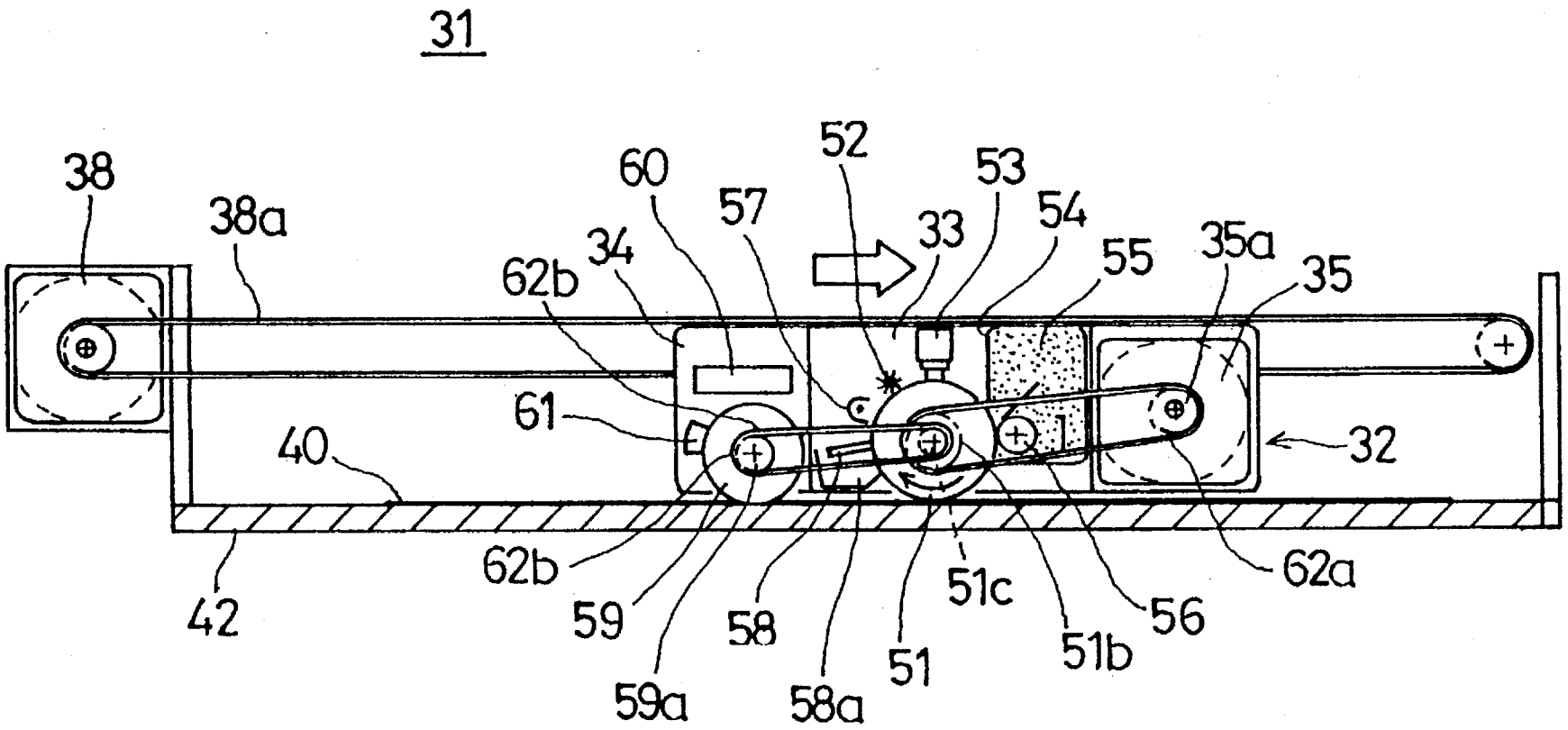
FIG. 4 is a cross sectional view showing the first embodiment of the printer.

Next, a description will be given of the construction within the carriage 32, by referring to FIG. 4. FIG. 4 shows a cross section of the construction shown in FIG. 3.

In FIG. 4, the carriage 32 is made up of the process part 33, the fixing part 34 and the process motor 35 as described above. A recording drum 51 having a rotary shaft 51*a* (not shown) parallel to the transport direction of the recording sheet 40 is provided on the process part 33. The rotary shaft 51*a* is shown in FIGS. 5A and 5B which will be described later. The recording drum 51 is provided as an image bearing member, and rotates on the recording sheet 40 that is on the transfer unit 42 at a peripheral speed synchronized to the movement of the carriage 32. Pulleys 51*b* and 51*c* having different diameters are provided on one end of the rotary shaft 51*a* of the recording drum 51. The pulley 51*b* has a diameter greater than that of the pulley 51*c*.

The surface of the recording drum 51 is uniformly charged by a charger 52, and an electrostatic latent image is formed on this surface by an exposure unit 53. The electrostatic latent image is visualized into a toner image by a toner 55 filled within a developer unit 54 and a developing roller 56. The toner image formed on the surface of the recording drum 51 is transferred onto the recording sheet 40 by applying a predetermined voltage across the recording drum 51 and the transfer unit 42 which confronts the recording drum 51 via the recording sheet 40.

After the toner image is transferred onto the recording sheet 40, a discharger 57 discharges the surface of the recording drum 51. The residual toner 55 on the surface of the recording drum 51 is scraped off and removed by a cleaner part 58*a* of a cleaner 58.

On the other hand, the fixing unit 34 includes a fixing roller 59 which is made up of a cylindrical magnetic member and having a teflon coating, for example. This fixing roller 59 is held by a flange or the like, and a pulley 59*a* is provided on a rotary shaft of this fixing roller 59. A heater part 60 and a silicon oil coater 61 are provided in a vicinity of the fixing roller 59. For example, the heater part 60 heats the fixing roller 59 by the induced heating technique. The silicon oil coater 61 coats silicon oil on the surface of the fixing roller 59 so as to improve the separation of the toner 55 at the surface of the fixing roller 59.

A pulley 35*a* is provided on one end of a rotary shaft of the process motor 35. This pulley 35*a* and the pulley 51*b* of the recording drum 51 are linked via a belt 62*a*. The pulley 51*c* of the recording drum 51 and the pulley 59*a* of the fixing roller 59 are linked via a belt 62*b*. In other words, the recording drum 51 and the fixing roller 59 are rotated by the process motor 35 via the belts 62*a* and 62*b*, in synchronism with the movement of the carriage 32.

Figure 5A:
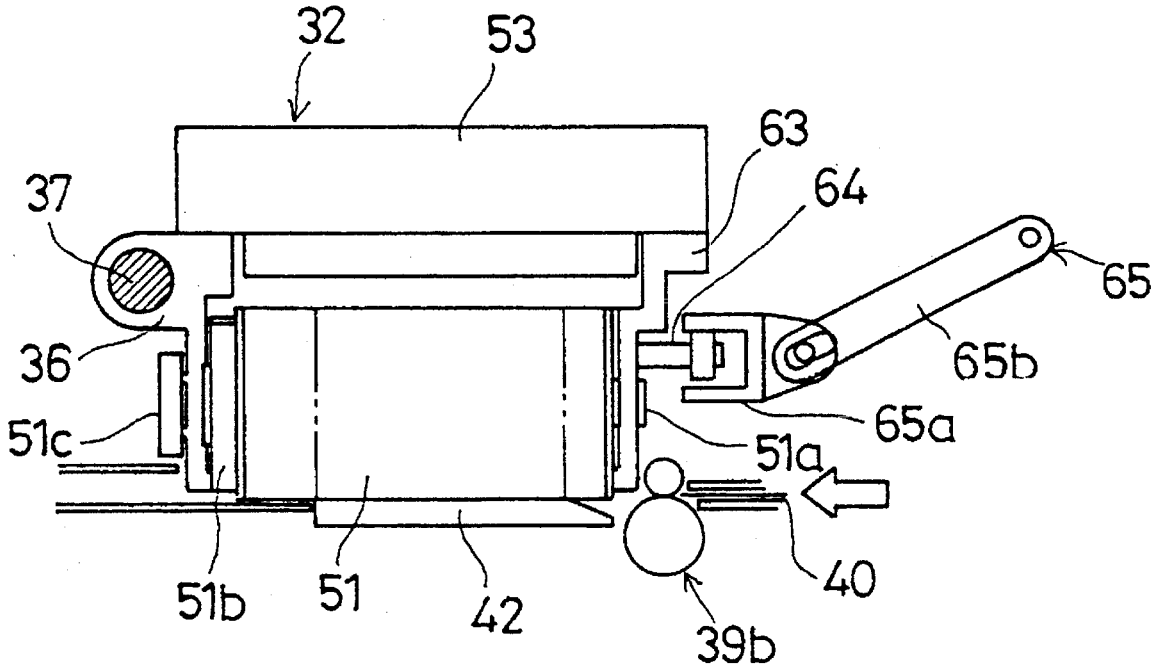
FIGS. 5A and 5B respectively are side views for explaining a carriage receding mechanism of the first embodiment.
Figure 5B:
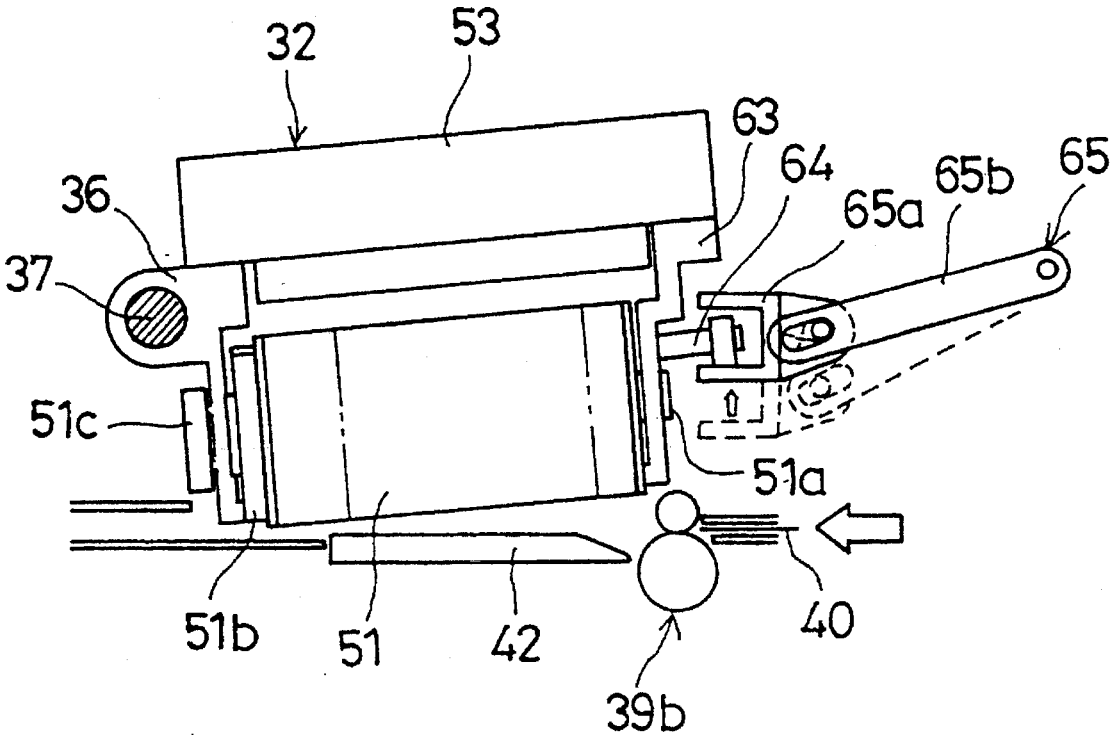

FIGS. 5A and 5B show the carriage receding mechanism of the first embodiment shown in FIG. 3. In FIGS. 5A and 5B, a support member 63 is provided on the end of the rotary shaft 51*a* of the recording drum 51 opposite to the end provided with the pulleys 51*b* and 51*c*. An engaging member 64 is provided on this support member 63. A receding mechanism 65 includes a first arm 65*a* and a second arm 65*b* which are pivotally supported thereon, and the first arm 65*a* engages the engaging member 64.

When the carriage 32 moves from a left end home position (receded position) towards the right in FIG. 4, the receding mechanism 65 puts the carriage 32 to a lowered position as shown in FIG. 5A. On the other hand, when the carriage 32 moves from the right end towards the home position, that is, recedes, the receding mechanism 65 raises the carriage 32 about the shaft 37 as shown in FIG. 5B.

Figure 6A:
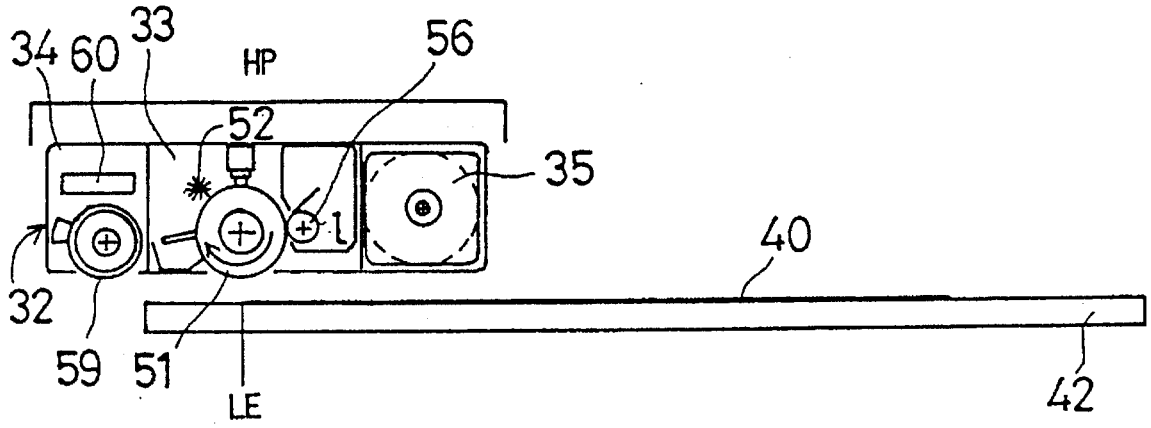
FIGS. 6A, 6B and 6C respectively are diagrams for explaining the operation of a carriage of the first embodiment.
Figure 6B:
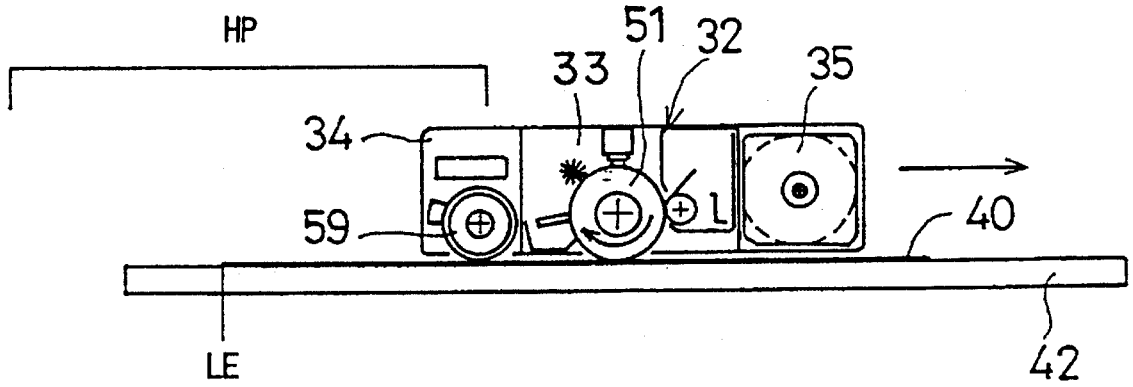
Figure 6C:
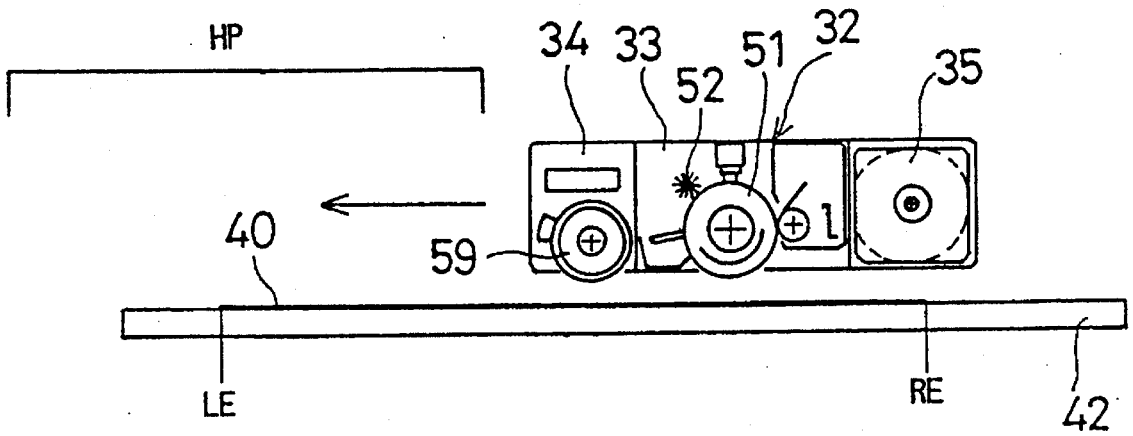

Next, a description will be given of the operation of the carriage 32 shown in FIGS. 3 through 5, by referring to FIGS. 6A through 6C. In FIGS. 6A through 6C, the illustration of the belts 62*a* and 62*b* for transmitting the driving force of the process motor 35 to the recording drum 51 and the fixing roller 59 are omitted. Further, in FIGS. 6A through 6C and FIGS. 8A and 8B which will be described later, HP denotes the home position, LE denotes the left end of the recording sheet 40, and RE denotes the right end of the recording sheet.

FIG. 6A shows a state where the carriage 32 is in a standby state at the home position (receded position) HP. That is, FIG. 6A shows an initial state at the time when a power supply is turned ON or, a returned state after the printing of one line ends. As shown in FIG. 5B, the carriage 32 is raised above the transfer unit 42 by the receding mechanism 65, and the recording drum 51 and the fixing roller 59 are positioned to make no contact with the transfer unit 42. In this case, it is sufficient to simply position the recording drum 51 approximately above the left end LE of the recording sheet 40, and it is possible to reduce the size of the printer 31 since no particular receding region for the carriage 32 needs to be provided outside the range of the recording sheet 40 in the horizontal direction.

In this state, the process motor 35 provided on the carriage 32 is rotated a predetermined time, so as to rotate the recording drum 51 and the fixing roller 59. The rotation of the recording drum 51 and the fixing roller 59 is carried out periodically in the standby state of the carriage 32. As a result, the position where the recording drum 51 makes contact with the developing roller 56 changes, and it is possible to avoid the undesirable effects of substances adhered on the recording drum 51 due to the contact between the recording drum 51 and the developing roller 56. In this case, if the recording drum 51 is rotated by an angle that is an integer multiple of 360°, the recording drum 51 will always make contact with the same position of the developing roller 56 when stopped. For this reason, the recording drum 51 is rotated by an angle that is other than the integer multiple of 360°.

In the case of the cleanerless construction, the residual toner on the recording drum 51 may be recovered by the developing roller 56. Furthermore, in order to prevent the extensive potential deterioration in this state, a bias voltage is applied to the charger 52 so as to charge the recording drum 51.

When the fixing roller 59 rotates, the surface part of the fixing roller 59 that is heated by the heater part 60 changes, thereby making the temperature distribution of the surface of the fixing roller 59 approximately uniform. Hence, it is unnecessary to heat the fixing roller 59 to a temperature above the rated value so as to heat the low-temperature part of the fixing roller 59, because no such low-temperature part exists. In addition, it is possible to prevent melting of the member such as the flange which is provided in a vicinity of the fixing roller 59. Therefore, it is possible to raise the temperature of the fixing roller 59 with an improved efficiency, thereby enabling a quick start of the printing operation.

Furthermore, it is also possible to clean the fixing roller 59 by removing the non-fixed toner adhered on the fixing roller 59.

FIG. 6B shows a state where the carriage 32 is moved in the main scan direction by the carriage motor 38, and the developing, transfer and fixing processes are carried out with respect to the recording sheet 40. In this state, the carriage 32 is in the state lowered by the receding mechanism 65 as shown in FIG. 5A, and the process motor 35 rotates the recording drum 51 and the fixing roller 59 in the main scan direction at the peripheral speed which is synchronized to the moving speed of the carriage 32.

In addition, FIG. 6C shows a state where the carriage 32 is moved to the home position HP (receded position) after ending the developing, transfer and fixing processes amounting to one line with respect to the recording sheet 40. In this state, the carriage 32 is in the state raised by the receding mechanism 65 as shown in FIG. 5B, and the process motor 35 rotates the recording drum 51 and the fixing roller 59. In this case, the peripheral speeds of the recording drum 51 and the fixing roller 59 need not be the same. Furthermore, the charging operation and the developing operation are carried out similarly as described above by applying the bias potentials to the charger 52 and the developing roller 56.

When the carriage 32 carries out the printing on the recording sheet 40 from the home position HP, the carriage 32 is raised by the receding mechanism 65 and the recording drum 51 and the fixing roller 59 are rotated by the process motor 35 even during the time when the carriage 32 moves from a predetermined position on the recording sheet 40 to the position where the printing starts.

In addition, although it was described above that the process motor 35 rotates both the recording drum 51 and the fixing roller 59 when the carriage 32 is raised by the receding mechanism 65, it is also possible to rotate only one of the recording drum 51 and the fixing roller 59. In this case, the transmission of the driving force of the process motor 35 to the recording drum 51 or the fixing roller 59 may be released by use of a one-way clutch (not shown) or the like.

Accordingly, the carriage 32 is raised by the receding mechanism 65 and the recording drum 51 is rotated by the process motor 35 during a time (or a mode) other than the time when the developing, transfer and fixing processes are carried out with respect to the recording sheet 40. Hence, it is possible to eliminate the undesirable effects of the charge deterioration and adherence of substances on the recording drum 51, and obtain a printed image having a high quality. In addition, by similarly rotating the fixing roller 59, it is possible to prevent melting of the member such as the flange in the vicinity of the fixing roller, and improve the safety of the printer 31. It is also possible to improve the efficiency with which the temperature of the fixing roller 59 may be raised, and a quick start of the printing operation becomes possible. Furthermore, in the case of the cleanerless construction, it is possible to recover the residual toner on the recording drum 51 by the developing roller 56, and accordingly prevent the quality of the printed image from becoming poor.

Figure 7:
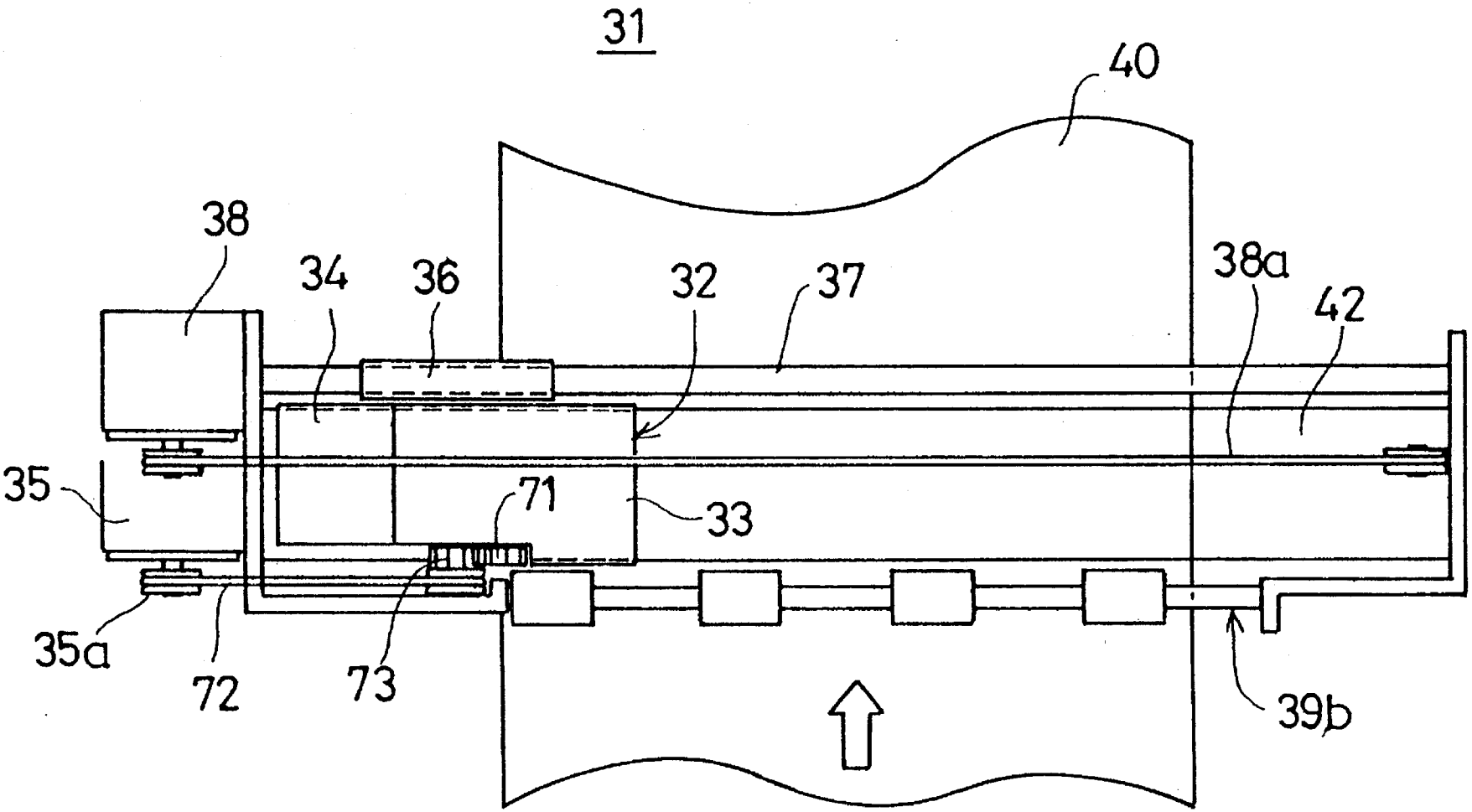
FIG. 7 is a plan view generally showing a second embodiment of the printer according to the present invention.

Next, a description will be given of a second embodiment of the printer according to the present invention, by referring to FIG. 7. FIG. 7 generally shows the second embodiment of the printer. More particularly, FIG. 7 shows a carriage part of the second embodiment. In FIG. 7, those parts which are the same as those corresponding parts in FIGS. 3, 4, 5A and 5B are designated by the same reference numerals, and a description thereof will be omitted.

In the electrophotography printer 31 shown in FIG. 7, the process motor 35 which is provided as a driving means for rotating the recording drum 51 of the process part 33 and the fixing roller 59 of the fixing unit 34 is provided on the main body in the vicinity of the receded position of the carriage 32. In addition, as will be described later, a pinion gear 71 is provided on one end of the recording drum 51 of the process part 33 opposite from the holder 36.

The driving force from the process motor 35 is transmitted to a gear 73 which is mounted on the main body, via the pulley 35*a* and a belt 72. This gear 73 is provided at a position to make meshing engagement with the pinion gear 71 when the carriage 32 is located at the home position HP (receded position). Although not shown in FIG. 7, a rack 74 is provided below the pinion gear 71. This rack will be described later in conjunction with FIGS. 8A and 8B.

Figure 8A:
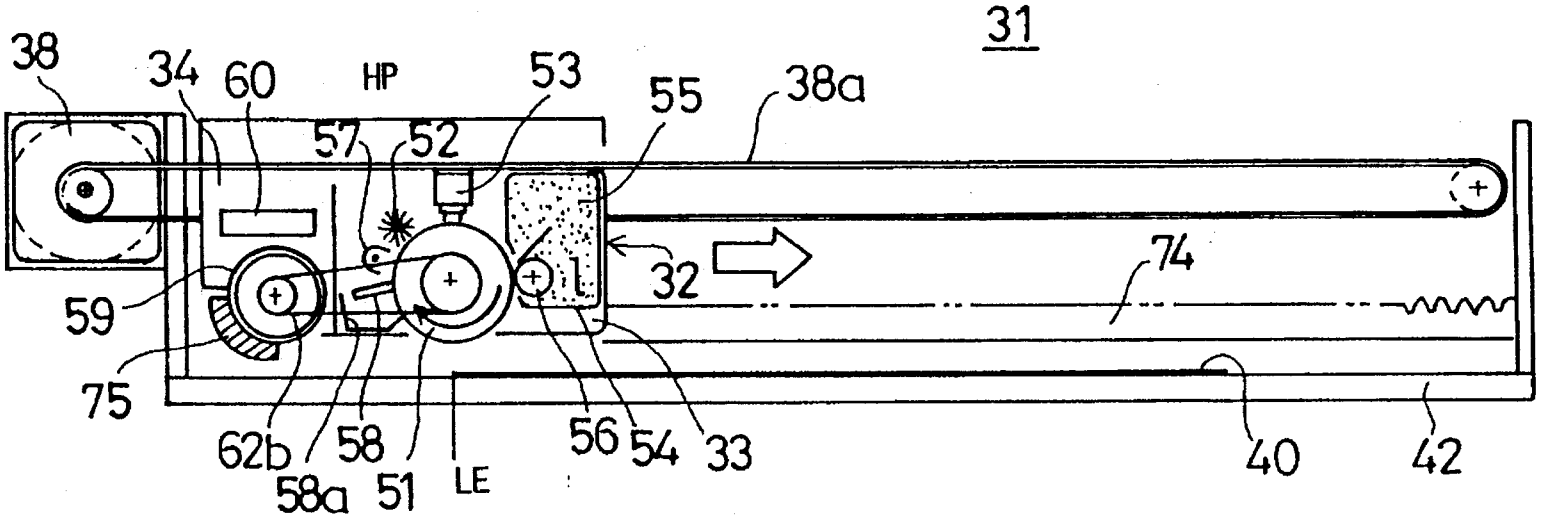
FIGS. 8A and 8B respectively are cross sectional views for explaining the second embodiment.
Figure 8B:
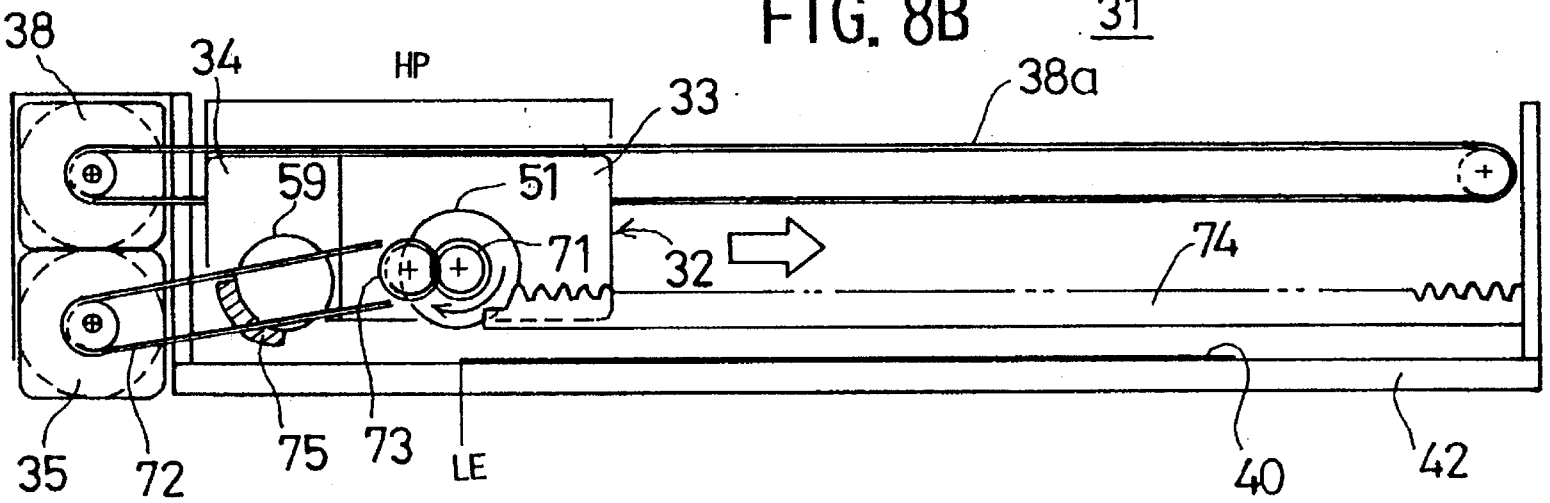
Figure 1A:
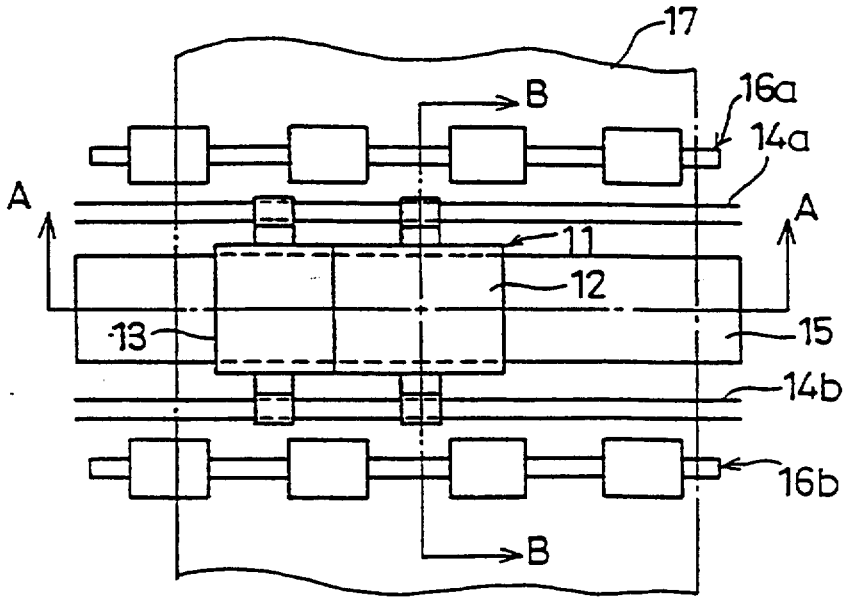
Figure 1B:
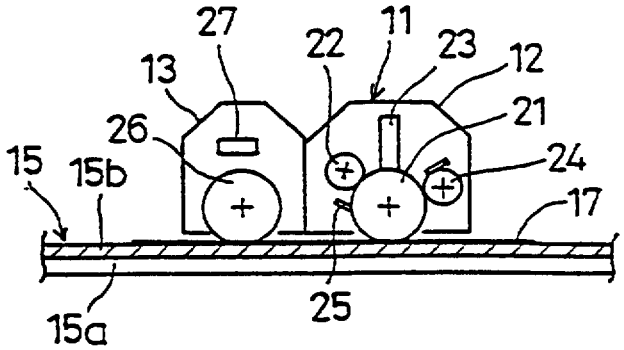
Figure 1C:
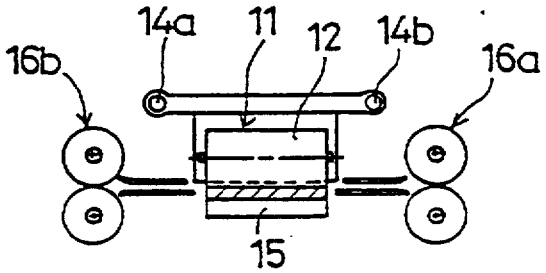
Figure 2:
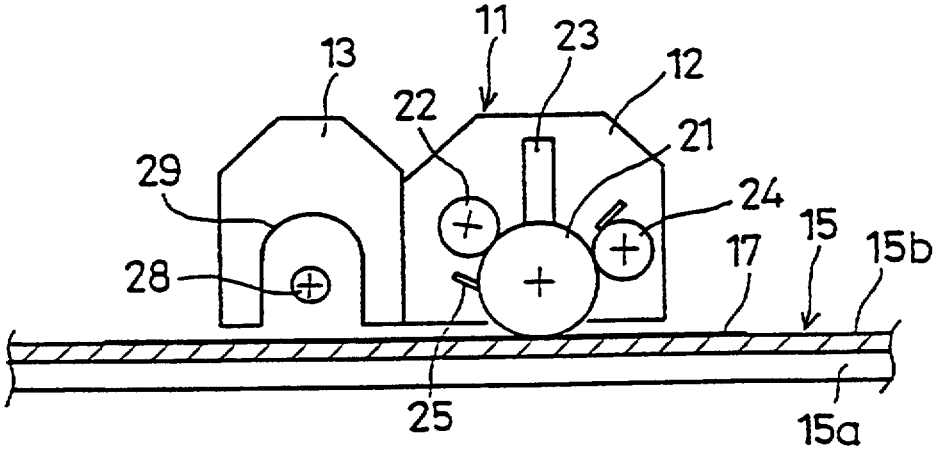

FIGS. 8A and 8B respectively show cross sections of the second embodiment shown in FIG. 7. FIG. 8A shows the cross section viewed from the side of the holder 36, and FIG. 8B, shows the cross section viewed from the side of the pinion gear 71.

In FIGS. 8A and 8B, the rack 74 which meshes with the pinion gear 71 is provided on the main body and extends in the main scan direction. This rack 74 has a length such that the meshing between the pinion gear 71 and the rack 74 is released when the carriage 32 is located at the home position HP. In addition, the silicon oil coater 75 is arranged at a position to make contact with the fixing roller 59 within the fixing unit 34 when the carriage 32 is located at the home position Hr.

The fixing roller 59 and the recording drum 51 within the carriage 32 are linked via the belt 62*b*. In addition, although the heater part 60 is illustrated as being provided within the fixing unit 34 with respect to the fixing roller 59, it is possible to fix the heater part 60 in a vicinity of the silicon oil coater 75 so that the fixing roller 59 is heated at the home position HP of the carriage 32. In this case, it is possible to provide an auxiliary heater (not shown) on the lower part of the transfer unit 42.

The receding mechanism of the carriage 32 in this embodiment is similar to that of the first embodiment shown in FIGS. 5A and 5B. In this case, however, it is possible to raise and lower the receding mechanism by the process motor 35. For example, the process motor 35 is rotated clockwise when operating the receding mechanism, and the process motor 35 is rotated counterclockwise when rotating the gear 73.

As shown in FIGS. 8A and 8B, at the home position (receded position) HP of the carriage 32, the gear 73 and the pinion gear 71 provided on the recording drum 51 mesh and are driven when the receding mechanism is driven by the process motor 35, for example. In this state, the carriage 32 is at the lowered position. In this case, the pinion gear 71 is disengaged from the rack 74. In addition, the fixing roller 59 within the fixing unit 34 makes contact with the silicon oil coater 75.

When the process motor 35 rotates, the recording drum 51 and the fixing roller 59 rotates. The rotational speeds of the recording drum 51 and the fixing roller 59 are respectively set to process speeds for carrying out a normal printing when making the charge operation with respect to the recording drum 51. On the other hand, when heating the fixing roller 59 during a warm-up prior to the start of the printing or when changing the contact position of the developing roller 56 with respect to the recording drum 51, the rotational speeds of the recording drum 51 and the fixing roller 59 may respectively be set to speeds lower than the process speeds. The recording drum 51 is periodically rotated in the initial state when the power supply is turned ON and in a preparation state of the printer 31. Furthermore, the recording drum 51 and the fixing roller 59 are rotated several times to clean the surfaces of the recording drum 51 and the fixing roller 59 after printing one line, when the carriage 32 returns to the home position HP, and after the carriage 32 reaches the home position HP.

When rotating the recording drum 51 and the fixing roller 59 by the process motor 35, it is possible to engage the gear 73 and the fixing roller 59 so as to mesh with each other. In this case, the recording drum 51 and the fixing roller 59 may be rotated independently if necessary using a one-way clutch (not shown).

According to this embodiment, it is also possible to prevent substances from adhering on the surface of the recording drum 51, and also obtain a uniform temperature distribution on the surface of the fixing roller 59. In addition, it is possible to prevent deterioration of the charge by making the charge operation with respect to the recording drum 51 using the charger 52. The safety and the efficiency of raising the temperature of the fixing roller 59 are improved by the uniform temperature distribution on the surface of the fixing roller 59. Furthermore, it is possible to improve the separation of the toner by coating the silicon oil on the surface of the fixing roller 59 by the silicon oil coater 75 which is provided externally to the fixing roller 59. In this case, since the silicon oil coater 75 is not provided in the fixing unit 34, it is possible to reduce the size of the carriage 32, reduce the power supply and the like because of the reduced size of the carriage 32, and reduce the overall size of the printer 31.

In this second embodiment, the process motor 35 is not provided on the carriage 32. Hence, the carriage 32 is light compared to that of the first embodiment, and it is therefore possible to reduce the size of the carriage motor 38 which drives the carriage 32 and the power supply or the like related thereto.

Further, the present invention is not limited to these embodiments, but various variations and modifications may be made without departing from the scope of the present invention.

What is claimed:

1. A serial type electrophotography printer comprising:

transport means for transporting a recording sheet in a transport direction;

a carriage including process means and fixing means, said process means including an image bearing member rotatable about a rotary axis parallel to the transport direction of the recording sheet and a toner developing a latent image formed by charging the image bearing member, said fixing means including a rotatable fixing member and heating means for heating the fixing member, said fixing member fixing a developed image which is transferred onto the recording sheet from the image bearing member;

driving means for rotating the image bearing member and the fixing member when said carriage is moved to carry out developing, transfer and fixing processes with respect to the recording sheet, and for rotating at least one of the image bearing member and the fixing member during a predetermined time other than the time when said carriage is moved to carry out the developing, transfer and fixing processes;

transfer means, confronting said carriage via the recording sheet in a main scan direction of said carriage, for transferring the developed image on the image bearing member onto the recording sheet; and moving means for moving said carriage in the main scan direction which is perpendicular to the transport direction of the recording sheet.

2. The serial type electrophotography printer as claimed in claim 1, wherein said driving means is provided within said carriage.

3. The serial type electrophotography printer as claimed in claim 1, which further comprises:

a receding mechanism for separating said carriage from said transfer means when moving said carriage to a predetermined receded position after carrying out the developing and transfer processes with respect to the recording sheet.

4. The serial type electrophotography printer as claimed in claim 1, wherein said carriage is located at a predetermined receded position in a standby state ready to start a print operation during the predetermined time.

5. The serial type electrophotography printer as claimed in claim 4, wherein said driving means rotates at least one of the image bearing member and the fixing member when moving said carriage to the predetermined receded position.

6. The serial type electrophotography printer as claimed in claim 4, wherein said driving means rotates at least one of the image bearing member and the fixing member for a predetermined time in a standby state when said carriage is located at the predetermined receded position.

7. The serial type electrophotography printer as claimed in claim 4, wherein said driving means is provided in a vicinity of the predetermined receded position of said carriage and rotates at least one of the image bearing member and the fixing member when said carriage is located at the predetermined receded position.

8. The serial type electrophotography printer as claimed in claim 7, which further comprises:

transmitting means for transmitting a driving force of said driving means to at least one of the image bearing member and the fixing member when said carriage is located at the predetermined receded position.

9. The serial type electrophotography printer as claimed in claim 7, which further comprises:

means for coating a material on the fixing member to facilitate separation of the toner from the fixing member when said carriage is located at the predetermined receded position.

10. The serial type electrophotography printer as claimed in claim 4, which further comprises:

means for carrying out at least a charging operation with respect to the image bearing member or a developing operation when the image bearing member is rotated at the predetermined receded position of said carriage.

* * * * *

UNITED STATES PATENT AND TRADEMARK OFFICE

CERTIFICATE OF CORRECTION

PATENT NO. :5,488,452

DATED :January 30, 1996

INVENTOR(S) :Ryoichi Iwama

It is certified that error appears in the above-identified patent and that said Letters Patent is hereby corrected as shown below:

In the Drawings:

Delete Drawings Sheets 1and 2, and substitute therefor the Drawing sheets, consisting of Figs. 1A, 1B, 1C and 2, as shown on the attached pages.

Signed and Sealed this

Eighth Day of October, 1996

*Attest:*

Bruce Lehman

BRUCE LEHMAN

*Attesting Officer*

*Commissioner of Patents and Trademarks*